US006820383B2

(12) United States Patent
Vos

(10) Patent No.: US 6,820,383 B2
(45) Date of Patent: Nov. 23, 2004

(54) MOSAIC-LIKE BRICK AND MOSAIC-LIKE SURFACES MADE USING SUCH BRICKS

(76) Inventor: Terrance D. Vos, 125 Larkspur La., Burlington, WI (US) 53105

( * ) Notice: Subject to any disclaimer, the term of this patent is extended or adjusted under 35 U.S.C. 154(b) by 237 days.

(21) Appl. No.: 10/002,834

(22) Filed: Nov. 1, 2001

(65) Prior Publication Data

US 2002/0088191 A1 Jul. 11, 2002

Related U.S. Application Data

(60) Provisional application No. 60/245,338, filed on Nov. 2, 2000.

(51) Int. Cl.[7] ..... E04F 19/00

(52) U.S. Cl. ..... 52/311.1; 52/311.2

(58) Field of Search ..... 52/311.1, 311.2, 52/314, 315, 316, 605, 607; 404/32, 44; 428/168, 156, 172, 173, 542.2

(56) References Cited

U.S. PATENT DOCUMENTS 150,710 A * 5/1874 Prindle
706,874 A * 8/1902 Alcan
763,064 A * 6/1904 Mercer
1,541,631 A * 6/1925 Duffy
1,622,969 A * 3/1927 Page
3,322,609 A * 5/1967 Vida
3,969,851 A * 7/1976 Whitacre ..... 52/98
4,884,922 A * 12/1989 Haq
5,172,532 A * 12/1992 Gobbar
5,487,526 A * 1/1996 Hupp
5,733,470 A * 3/1998 Roth
5,884,445 A * 3/1999 Woolford ..... 52/311.2
6,309,716 B1 * 10/2001 Fisher et al. ..... 428/33
6,350,498 B1 * 2/2002 Hess

FOREIGN PATENT DOCUMENTS

CA 510934 * 5/1955
FR 2402-749 * 9/1977

* cited by examiner

*Primary Examiner*—Brian E. Glessner
*Assistant Examiner*—Kevin McDermott
(74) *Attorney, Agent, or Firm*—Jansson, Shupe & Munger, Ltd.

(57) ABSTRACT

An improved decorative brick having a display face with a network of deep interconnected grooves to produce a mosaic-like appearance, and patios made with such brick. A manufacturing method for such decorative brick.

14 Claims, 4 Drawing Sheets

MOSAIC-LIKE BRICK AND MOSAIC-LIKE SURFACES MADE USING SUCH BRICKS

RELATED APPLICATION

This application claims the benefit of United States provisional patent application Serial No. 60/245,338, filed Nov. 2, 2000, entitled "Mosaic-Like Brick and Method of Manufacture."

FIELD OF THE INVENTION

This invention is related generally to decorative bricks and brickwork and, more particularly, to bricks used for aesthetic display.

BACKGROUND OF THE INVENTION

Bricks and brickwork, including bricks and brickwork for patios, are a well known art. Indeed, bricks having been made and used since as far back as 1330 B.C. Bricks are one of mankind's oldest known manufactured materials, and have been found in the ruins of ancient civilizations including parts of the Great Wall of China.

Bricks are made from a mixture usually comprised of clay and shale that has been ground to a fine consistency. Such a mixture is mixed with water, blended and then fired to approximately 2000° F. During such heating process, the molecular and/or crystalline structure of the clay is changed; the clay is vitrified much like a clay pot that has gone through a firing process. The color of brick is determined by the raw materials it contains, the additives and coatings applied to the surface, and the variance of firing atmosphere known as "flashing."

Brick has long been used for construction of walking or driving surfaces because of its excellent strength and wear resistance, and also because of its attractive decorative appearance. Decorative brick is particularly popular for patios and the like, and the term "patio" is used herein to refer to any generally horizontal walking or driving surface, whether or not particular examples of such surfaces are commonly referred to by that term.

Another popular display surface, primarily horizontal for walking thereon, is what is referred to as a mosaic. A mosaic surface is formed, for example, by inlaid bits or pieces of stone, often pieces which are of generally similar sizes (within a wide range of sizes) by very random shapes. While mosaics may often be formed to achieve particular recognizable images, the term "mosaics" as used herein refers to a group of pieces laid together to form a surface, whether or not there is some intended image.

Laying horizontal patio surfaces using a great number of somewhat randomly shaped pieces of stone, brick material or the like, in some sort of mosaic pattern or the like, is an extremely expensive and time-consuming process, but the resulting patio surfaces are usually extremely attractive and valuable.

Bricks of varying decorative face types are well known in the art. It is also known in the brick art that the face of the brick can be changed by applying various coatings, by scoring the surface, or other surface treatments, in order to create differing surface textures. Although such varying of the brick face is known, it is not known to alter the brick so as to create a mosaic appearance that is aesthetically pleasing and yet is readilyy capable of being easily installed and displayed in brickwork such as that associated with a patio.

A unitary decorative brick that creates a realistic appearance of being a multiplicity of separate pieces, rather than one, would be an important improvement in the art as it would allow for the creation of a wide variety of aesthetic displays, such as mosaics, and would do so in minimal time and for a low cost.

OBJECTS OF THE INVENTION

It is an object of this invention to provide an improved decorative brick with mosaic-like appearance that overcomes some of the problems and shortcomings of the prior art.

Another object of this invention is to provide an improved decorative brick which can be used to create mosaic-like patios.

Another object of this invention is to provide a method of manufacturing a decorative brick which brick overcomes some of the problems and shortcomings of the prior art.

Still another object of this invention is to provide a decorative brick which allows rapid creation of mosaic-like patios.

Another object of this invention is to provide an improved decorative brick, and a method for making a decorative brick with a preformed display face.

Still another object of the invention is to provide an improved decorative brick and method for making a decorative brick with display-face portions giving the visual impression of each portion representing a separate solid piece as is typically used in formation of mosaic surfaces.

These and other objects of the invention will be apparent from the following descriptions and from the drawings.

SUMMARY OF THE INVENTION

The invention involves an improved decorative brick where the brick, as with most brick, has a display face and aback face that axe spaced apart by a first dimension. The improvement involves each such brick having a network of interconnected grooves opening at its display face. The grooves have widths at the display face and extend from the display face into the brick toward, but stopping short of, the back face. The depths of such grooves are at least twice the widths of the such grooves at the display face.

In certain embodiments of the invention, the grooves extend from the display face toward the back face to a depth that is at least four times the widths of the grooves. The interconnected grooves preferably have varying widths, and any one groove of the network may itself have varying widths along its length.

Referring more specifically to the grooves, each of the grooves has (a) an elongate open end formed by a pair of spaced edges defining a gap at the display face and (b) an elongate closed end spaced from the display face. The gap at the open end is of first width(s), and the closed end is of second width(s) which is (are) narrower than the first width(s). The interconnected grooves preferably have gaps of varying widths, and as already indicated at least one of the individual grooves preferably has a gap of varying widths along its length.

In preferred embodiments, the first dimension, which separates the display face from the back face of the brick, is about 2½ to 3 inches and the depth(s) of the grooves is (are) at least about ½ inch and the widths of the grooves are least about 1/16th of an inch.

It is highly preferred that a filler be located within the interconnected grooves. In one version of such embodiment, the filler is sand. The sand is preferably loosely located within the grooves. Such a network of grooves forms a mosaic on the display face, and the sand or other filler serves to enhance the mosaic-like appearance of the decorative brick of this invention.

The invention also involves a method for making decorative bricks comprising the steps of: (1) preparing a brick-material mix; (2) inserting the brick-material mix into a mold; (3) placing a surface-molding panel on the brick-material mix, the surface-molding panel having an inboard side that includes a network of protrusions that are at least twice as long as they are wide and that extend into the brick-material mix; (4) firing the brick-material mix in an oven until hardened into a brick; (5) taking the hardened brick-material mix out of the oven; (6) removing the cover panel from the mold, thereby exposing a decorative brick having a display face with a network of interconnected grooves; and (7) dislodging the brick from the mold.

In a preferred embodiment of the inventive method, the surface-molding panel is removed prior to firing the brick-material mix.

Another aspect of this invention is a decorative-brick patio which is formed of a multiplicity of bricks of the invention. That is, the patio includes decorative bricks each of which has a display face and a back face spaced apart by a first dimension, the decorative bricks each having thereon a network of interconnected grooves having widths, such grooves extending from the display face toward the back face to depths that are at least twice, and preferably four times, the widths.

As indicated above, the decorative bricks of the patio of this invention preferably have a first dimension, i.e., the dimension which separates the display face and the back face, of at least about 2½ inches, and the depths of the grooves are at preferably at least about ½ inch.

In certain highly preferred embodiments, the decorative bricks forming the patio include a plurality of first decorative bricks and a plurality of second decorative bricks, the first decorative bricks having square display faces of a first fixed size and the second decorative bricks have rectangular display faces which are substantially equal in size and shape to one-half of the display faces of one of the first decorative bricks.

The first decorative bricks and second decorative bricks of such patio are preferably positioned among each other in an edge-adjacent array. Most preferably, the first decorative bricks in the array are oriented in a plurality of different orientations, and the second decorative bricks in the array are oriented in a plurality of different orientations. This greatly enhances the mosaic simulation, because it creates a large number of relationships which tend to "hide" the fact that, at least in some embodiments, all the first decorative bricks have the same patterns of interconnected grooves, and all of the second decorative bricks have the same patterns (but different from the pattern of the first decorative bricks) of interconnected grooves.

The variation and decorative appearance of patios in accordance with this invention can also be enhanced by using decorative bricks of this invention with markedly difference densities of "pieces" on their decorative faces.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTIONS OF PREFERRED EMBODIMENTS

Figure 1:
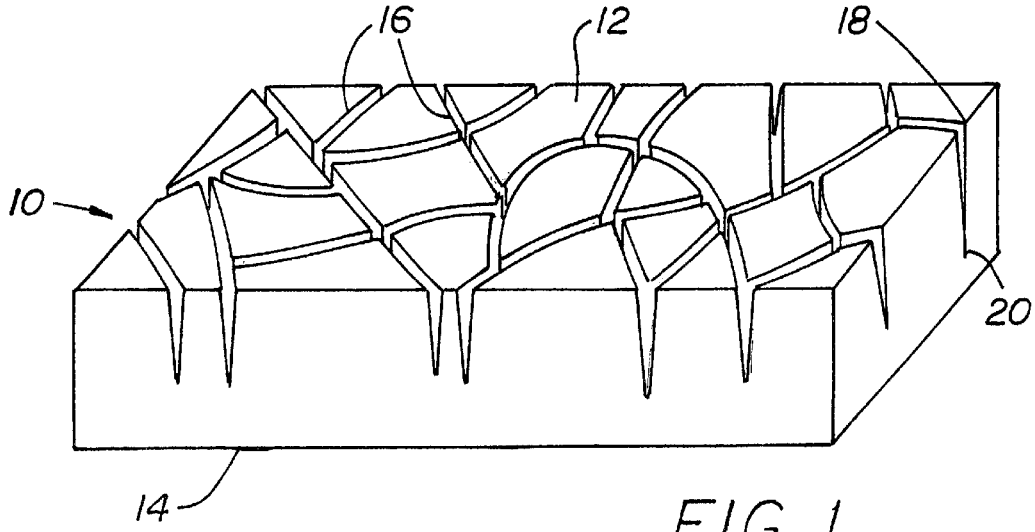
FIG. 1 is a perspective view of a decorative brick in accordance with this invention.
Figure 2:
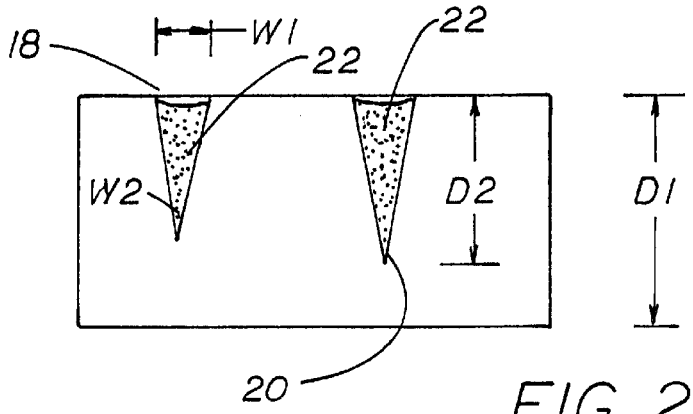
FIG. 2 is an enlarged right side elevation of the decorative brick of FIG. 1.
Figure 3:
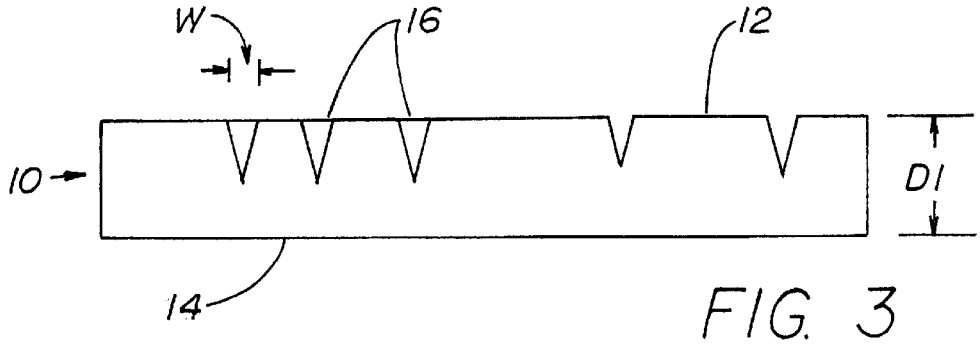
FIG. 3 is a front elevation of the decorative brick of FIG. 1.
Figure 4:
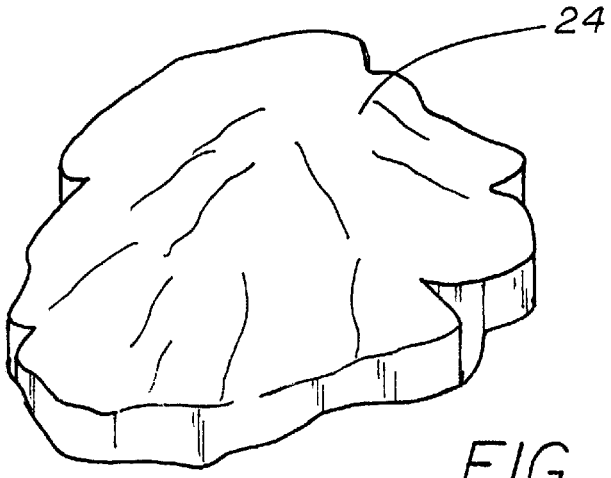
FIG. 4 is a perspective view showing a brick-material mix used in the manufacture of the decorative bricks of this invention.
Figure 5:
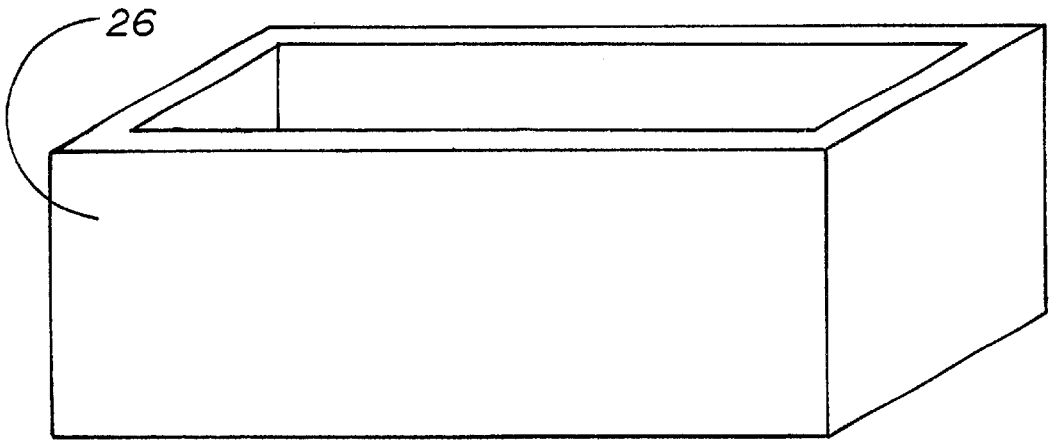
FIG. 5 is a perspective view of a mold used in the brick-making method of this invention.
Figure 6:
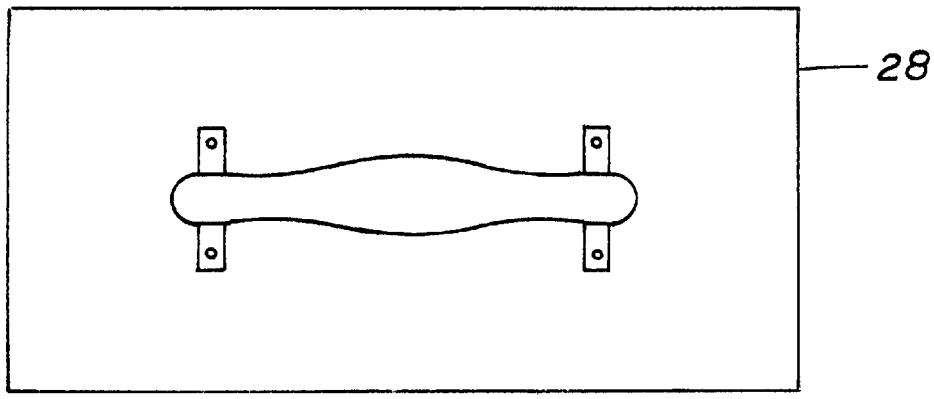
FIG. 6 is a top view of a surface-molding panel tool usable in the method of this invention.

FIGS. 1–3 illustrate the improved brick 10 of this invention in greatest detail. Brick 10 has a display face 12 and a back face 14 that are spaced apart by a first dimension D1. Brick 10 has, formed on display face 12, a network of interconnected grooves 16 having widths W. Grooves 16 extend into brick 10 from display face 12 toward back face 14 to a depth D2 that is more than four times the widths of grooves 16. The interconnected grooves 16 have slightly varying widths.

As illustrated in FIG. 2, grooves 16 each have an elongate open end 18 (defined between a pair of spaced edges) and an elongate closed end 20. The elongate open end 18 has a first width W1 and the elongate closed end 20 has a second width W2. First width W1 is greater than second width W2.

In such an embodiment, first dimension D1 separating display face 12 and back face 14 is between approximately 2½ to 3 inches. In some cases, first dimension D1 may be greater; such thicker brick is often used for driveways and the like. The depths of grooves 16 are at least ½ inch, and the widths of grooves 16 are at least 1/16th of an inch. Groove widths can vary greatly, and are usually more than 1/16th of an inch. The depths of the grooves on a brick in accordance with this invention may be equal, or may vary. Such depths are preferably not so large as might threaten the integrity of the brick.

As shown in FIG. 2, a filler 22, which is sand, is located in grooves 16, its top surface being slightly recessed from the top surface of the brick. Suitable materials other than sand 22 include crushed stone, tar or dirt. Sand 22 is loosely located in the widths. Such a network of grooves 16 forms a mosaic on the display face 12. While sand 22 is loosely within grooves 16, the sand or other filler can be hardened in place.

While a mosaic display may be the preferred embodiment, nothing in the invention limits the nature of the network of deep, narrow grooves in the display face of the decorative brick of this invention.

The invention also involves a method, as illustrated in FIGS. 4–8, for making bricks 10. The method of this invention involves: preparing a brick-material mix 24; inserting the brick-material mix 24 into a mold 26; placing a surface-molding panel 28 on the brick-material mix 24, the surface-molding panel 28 having an inboard side 30 that includes a network of protrusions 32 that are at least twice as long as they are wide and that extend into the brick-material mix 24; firing the brick-material mix 24 in an oven until hardened into a brick 10; taking the hardened brick-material mix 24 out of the oven; removing the surface-molding panel 28 from the mold 26, thereby exposing a brick 10 having a display face 12 with a network of interconnected grooves 16; and dislodging the brick 10 from the mold 26.

The brick-material mix can be any mixture suitable for the manufacture of bricks including, but not limited to, a clay-like mixture, a concrete mixture and an aggregate mixture.

Figure 7:
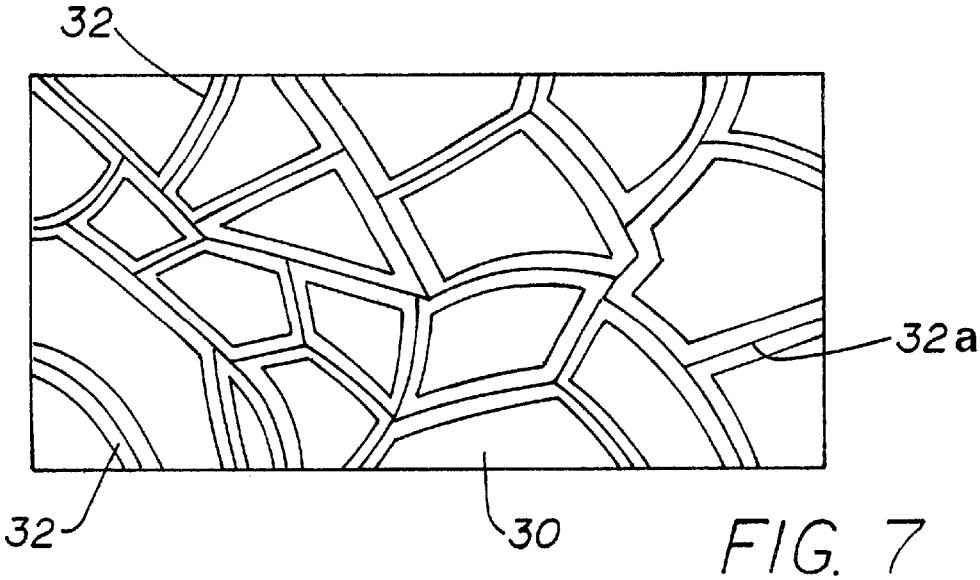
FIG. 7 is a bottom view of the surface-molding panel tool of FIG. 6.
Figure 8:
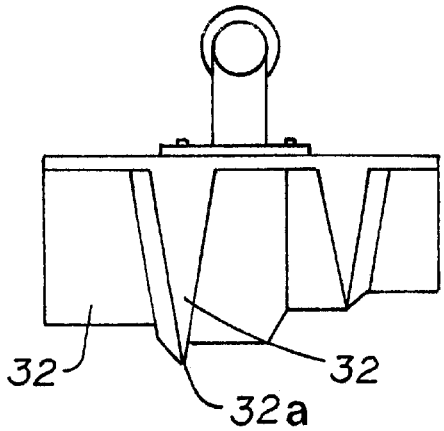
FIG. 8 is an end elevation view of the surface-molding panel tool of FIGS. 6 and 7.

As shown best in FIGS. 7 and 8, protrusions 32, while very narrow, are tapered to fairly sharp distal edges 32*a*. This tapering facilitates withdrawal of surface-molding panel 28 after the decorative form is established. In a preferred embodiment of the inventive method, the surface-molding panel 28 is removed prior to firing the brick-material mix.

While the manufacture of bricks 10 is illustrated as a manual process, manufacture can instead be automated. In such cases, known brick-making equipment can be modified to carry out the inventive method and produce brick 10.

In a particular version of the method, the protrusions on the inboard side of the surface-molding panel may form any one of a number of mosaic-like patterns.

Figure 9:
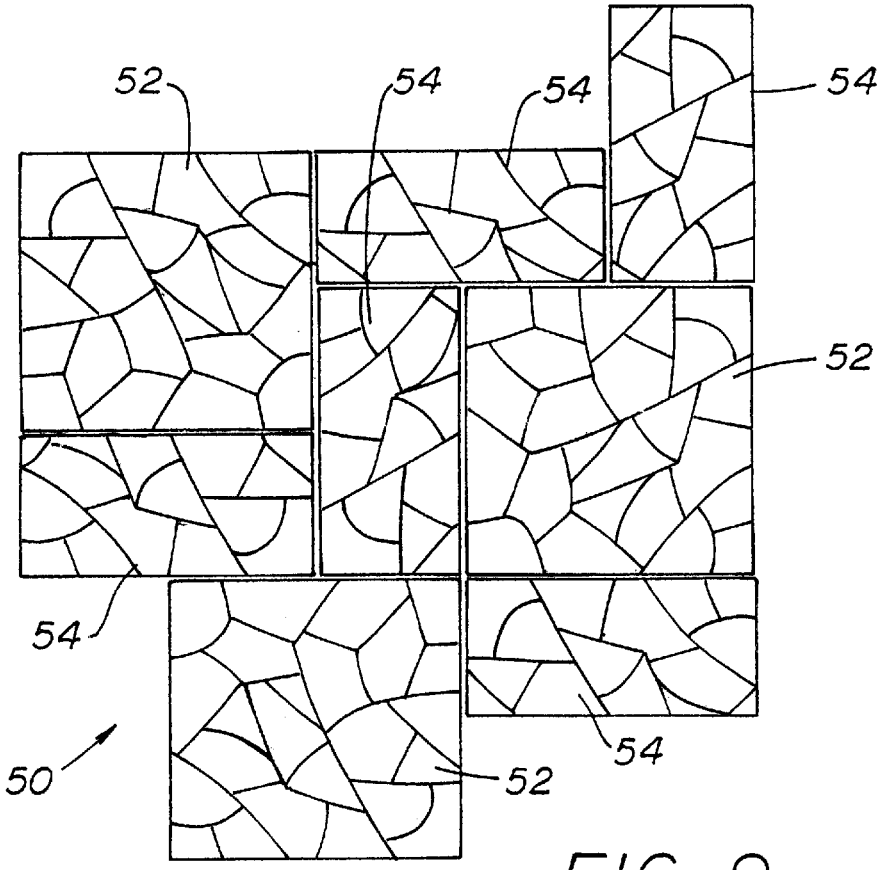
FIG. 9 is a top view of a patio formed of with the decorative bricks of this invention.

FIG. 9 illustrates a preferred patio 50 in accordance with this invention. Patio 50 is formed by a plurality of large square first decorative bricks 52, each of which is identical to the others, and another plurality of rectangular second decorative bricks 54, second bricks 54 having rectangular display faces which are substantially equal in size and shape to one-half of the display face of one of first decorative bricks 52. All of bricks 52 and 54 are in accordance with this invention, as described above. First decorative bricks 52 and second decorative bricks 54 of patio 50 are positioned among each other in an edge-adjacent array, as shown in FIG. 9.

Bricks 52 and 54 in patio 50 are oriented in different ways to achieve an enhanced mosaic-like appearance. Most specifically, the several first decorative bricks 52 in the array are oriented in four different orientations, the orientation being rotated 90° from one another. Likewise, the several second decorative bricks 54 are oriented in four different orientations, rotated 90° from one another. Therefore, with differing placements and differing orientations of the several first bricks 52 and the several second bricks 54, the number of different appearance relationships is very large, and this tends to minimize any perception of repetition. The mosaic simulation is made even better than is otherwise the case.

Figure 10:
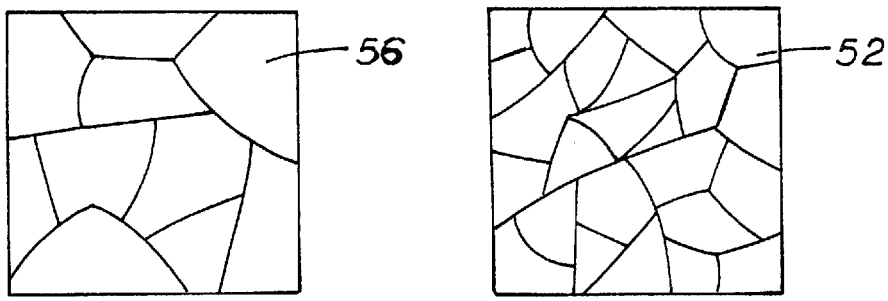
FIG. 10 shows the display faces of two decorative bricks having display faces with mosaic-simulations of differing densities.

FIG. 10 illustrates two different decorative bricks 52 and 56 in accordance with this invention. Decorative brick 52 is a square decorative brick like that used in patio 50, while decorative brick 56 is of identical size but with a different network of interconnected grooves than that of decorative brick 52. More specifically, the network of interconnected grooves of decorative brick 56 less complex than that of decorative brick 52, and therefore gives the appearance of a lesser density of mosaic-forming "pieces" than is the case for decorative brick 52. Such variations in "piece" density, whether in bricks of equal or different sizes, can be artistically useful in designing patios. An essentially unlimited number of decorative arrays and patterns are possible, and the possibilities are increased by use of decorative bricks with differing "piece" densities.

While the principles of this invention have been described in connection with specific embodiments, it should be understood clearly that these descriptions are made only by way of example and are not intended to limit the scope of the invention.

What is claimed is:

1. In discrete decorative bricks preformed for subsequent use in laying horizontal patio-brick surfaces, each such discrete brick having (a) a display face, (b) a preformed planar back face spaced a constant first dimension from the display face, such back face and first dimension being identical with the back faces and comparable dimensions of other such bricks, and (c) four preformed lateral abutment surfaces for abutment with the lateral abutment surfaces of other such bricks, each abutment surface being substantially uniplanar, orthogonal to and adjoining with two of the other lateral abutment surfaces of the brick the improvement wherein the discrete brick includes a network of interconnected grooves at least some of which have varying display-face widths along their lengths, the grooves extending from the display face toward the back face to depths that are at least twice the display-face widths, thereby to form a multiplicity of irregularly-shaped mosaic-bit surfaces on the display face to form a mosaic simulation thereon.

2. The decorative brick of claim 1 wherein the grooves extend from the display face toward the back face to depths that are at least four times the widths of the grooves.

3. The decorative brick of claim 1 wherein:

each of the grooves has (a) an elongate open end formed by a pair of spaced edges defining a gap at the display face and (b) an elongate closed end spaced from the display face;

the gap at the open end is of first width(s); and the closed end is of second width(s) narrower than the first width(s).

4. The decorative brick of claim 3 wherein each of the interconnected grooves has a gap of varying widths along its length.

5. The decorative brick of claim 1 wherein:

the first dimension separating the display face and the back face is at least about 2½ inches; and the depth of the grooves is at least about ½ inch.

6. The decorative brick of claim 5 wherein the display-face widths of the grooves are at least about 1/16 inch.

7. The decorative brick of claim 1 wherein a filler is located in the grooves.

8. The decorative brick of claim 7 wherein the filler is sand.

9. The decorative brick of claim 8 wherein the sand is loosely located in the grooves.

10. In a decorative-brick patio formed of a multiplicity of preformed discrete decorative bricks each such discrete brick having (a) a display face, (b) a preformed planar back face spaced a constant first dimension from the display face, such back face and first dimension being identical for the bricks, and (c) four preformed lateral abutment surfaces abutting the lateral abutment surfaces of the other preformed bricks, each abutment surface being substantially uniplanar, orthogonal to and adjoining with two of the other lateral abutment surfaces of the brick, the improvement wherein the display faces of the discrete decorative bricks of the patio each have thereon a network of interconnected grooves at least some of which have varying display-face widths, such grooves extending from the display face toward the back face to depths that are at least twice the display-face widths, thereby to form a multiplicity of irregularly-shaped mosaic-bit surfaces on the display face to form a mosaic simulation thereon.

11. The decorative-brick patio of claim 10 wherein:

the first dimension separating the display face and the back face is at least about 2½ inches;

the depths of the grooves are at least about ½ inch; and the display-face widths of the grooves are at least about 1/16 inch.

12. The decorative-brick patio of claim 11 wherein the decorative bricks include a plurality of first decorative bricks and a plurality of second decorative bricks, and wherein:

the first decorative bricks have square display faces of a first fixed size; and the second decorative bricks have rectangular display faces which are substantially equal in size and shape to one-half the display face of one of the first decorative bricks.

13. The decorative-brick patio of claim 12 wherein the first decorative bricks and second decorative bricks are positioned among each other in an edge-adjacent array.

14. The decorative-brick patio of claim 13 wherein:

the first decorative bricks in the array are oriented in a plurality of different orientations; and the second decorative bricks in the array are oriented in a plurality of different orientations, whereby the mosaic simulation is enhanced.

* * * * *